US011945625B2

(12) United States Patent
Owen

(10) Patent No.: US 11,945,625 B2
(45) Date of Patent: Apr. 2, 2024

(54) PACKAGE WITH CLOSURE

(71) Applicant: Closure Systems International Inc., Indianapolis, IN (US)

(72) Inventor: Robert H. Owen, Crawfordsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 20 days.

(21) Appl. No.: 17/848,543

(22) Filed: Jun. 24, 2022

(65) Prior Publication Data

US 2023/0415963 A1 Dec. 28, 2023

(51) Int. Cl.
*B65D 43/02* (2006.01)
*B65D 41/04* (2006.01)
*B65D 41/34* (2006.01)

(52) U.S. Cl.
CPC ..... *B65D 43/0283* (2013.01); *B65D 41/0471* (2013.01); *B65D 41/3428* (2013.01); *B65D 2401/20* (2020.05)

(58) Field of Classification Search
CPC ..... B65D 43/0283; B65D 41/0471; B65D 41/3428; B65D 2401/20
USPC ..... 215/329
See application file for complete search history.

(56) References Cited

U.S. PATENT DOCUMENTS 2,162,880 A 6/1939 Brown
2,423,582 A 7/1947 Coleman
3,147,876 A 9/1964 Lepore
3,160,327 A 12/1964 Porcelli
3,199,702 A 8/1965 Fischbach
3,282,477 A 11/1966 Henchert
3,295,708 A 1/1967 Wathen
3,405,831 A 10/1968 Hudson
3,415,403 A 12/1968 Bardell
3,620,400 A 11/1971 Brown
3,667,638 A 6/1972 Cambio, Jr.
3,682,345 A 8/1972 Baugh
(Continued)

FOREIGN PATENT DOCUMENTS

EP 0 008 190 A1 2/1980
GB 1 052 734 A 12/1966
(Continued)

*Primary Examiner* — J. Gregory Pickett
*Assistant Examiner* — Niki M Eloshway
(74) *Attorney, Agent, or Firm* — NIXON PEABODY LLP

(57) ABSTRACT

A package includes a container and closure. The container has a neck portion defining an opening. The container has an external thread formation and catch lugs. The closure fits to the neck portion for closing the opening. The closure includes first and second closure portions. The first closure portion includes a top wall portion and a skirt portion. The skirt portion depends from the top wall portion. The skirt portion includes an internal thread formation for mating engagement with the external thread formation. The second closure portion includes a tamper-evident band depending from and being partially detachably connected to the skirt portion by a frangible connection. An interior surface of the second closure portion includes catch teeth. The catch lugs mechanically catch and lock with a respective one of the catch teeth to prevent or inhibit the second closure portion from being removed during the opening of the container.

22 Claims, 13 Drawing Sheets

(56) References Cited

U.S. PATENT DOCUMENTS 3,741,421 A 6/1973 Wittwer
3,904,061 A 9/1975 Keeler
3,987,921 A 10/1976 Aichinger
4,007,848 A 2/1977 Snyder
RE29,850 E 11/1978 Labarre
4,171,749 A 10/1979 Obrist
4,180,175 A 12/1979 Virog
4,345,690 A 8/1982 Hopley
4,345,691 A 8/1982 Burke
4,382,521 A 5/1983 Ostrowsky
4,418,828 A 12/1983 Wilde
4,423,820 A 1/1984 Vangor
4,427,126 A 1/1984 Ostrowsky
4,456,137 A 6/1984 Lyman
4,458,822 A 7/1984 Ostrowsky
4,461,394 A 7/1984 Sendel
4,470,513 A 9/1984 Ostrowsky
4,497,765 A 2/1985 Wilde
4,505,401 A 3/1985 Berglund
4,506,795 A 3/1985 Herr
4,533,062 A 8/1985 Krautkramer
4,534,480 A 8/1985 Santostasi
4,550,844 A 11/1985 Lininger
4,562,931 A 1/1986 Brach
4,573,601 A 3/1986 Berglund
4,592,476 A 6/1986 Yasada
4,609,115 A 9/1986 Moore
4,630,743 A 12/1986 Wright
4,635,808 A 1/1987 Nolan
4,638,917 A 1/1987 Persch
4,674,643 A 6/1987 Wilde
4,682,702 A 7/1987 Gach
4,697,715 A 10/1987 Beruvides
4,738,730 A 4/1988 Urmston
4,747,502 A 5/1988 Luenser
4,813,561 A 3/1989 Ochs
4,818,828 A 4/1989 Curley
4,938,370 A 7/1990 McBride
4,971,212 A 11/1990 Kusz
4,978,017 A 12/1990 McBride
4,981,230 A * 1/1991 Marshall ..... B65D 41/3428 D9/453
4,993,570 A 2/1991 Julian
4,997,097 A 3/1991 Krautkramer
5,050,753 A 9/1991 Trump
5,167,335 A 12/1992 McBride
5,184,741 A 2/1993 Chevassus
5,190,177 A 3/1993 Collins
5,197,620 A 3/1993 Gregory
5,205,426 A 4/1993 McBride
5,292,020 A 3/1994 Narin
5,301,849 A 4/1994 Guglielmini
5,307,946 A 5/1994 Molinaro
5,314,085 A 5/1994 Bonet
5,328,044 A 7/1994 Rohrs
5,346,082 A * 9/1994 Ochs ..... B65D 51/145 215/276
5,356,021 A 10/1994 McBride
5,366,774 A 11/1994 Pinto
5,450,972 A 9/1995 Zemlo
5,480,045 A 1/1996 Molinaro
5,501,349 A 3/1996 McCandless
5,564,582 A 10/1996 Kamath
5,588,545 A 12/1996 King
5,593,055 A * 1/1997 Repp ..... B65D 41/17 215/354
5,676,270 A 10/1997 Roberts
5,715,959 A 2/1998 Pfefferkorn
5,735,426 A 4/1998 Babcock
5,755,360 A 5/1998 Elliott
5,782,369 A 7/1998 Tansey
5,785,209 A 7/1998 Guglielmini
5,797,506 A 8/1998 Lehmkuhl
5,800,764 A 9/1998 Smeyak
5,810,207 A 9/1998 Hayashida
5,829,611 A 11/1998 Beck
5,845,798 A 12/1998 Carrier
5,860,542 A 1/1999 Takamatsu
5,875,942 A 3/1999 Ohmi
5,884,790 A 3/1999 Seidita
5,915,574 A 6/1999 Adams
5,915,579 A 6/1999 Przytulla
5,950,850 A 9/1999 Takamatsu
6,006,930 A 12/1999 Dreyer
6,016,931 A 1/2000 Ohmi
6,044,992 A 4/2000 Ma
6,056,136 A 5/2000 Taber
6,085,921 A 7/2000 Brown
6,089,390 A 7/2000 Druitt
6,109,465 A 8/2000 Henning
6,112,923 A 9/2000 Ma
6,116,445 A 9/2000 Ikemori
6,123,212 A 9/2000 Russell
6,202,872 B1 3/2001 Smeyak
6,247,605 B1 6/2001 Fujie
6,276,543 B1 8/2001 German
6,325,225 B1 12/2001 Druitt
6,371,317 B1 4/2002 Krueger
6,484,896 B2 11/2002 Ma
6,527,132 B1 3/2003 Druitt
6,557,714 B2 5/2003 Babcock
6,574,848 B2 6/2003 Fujie
6,673,298 B2 1/2004 Krueger
6,705,479 B2 3/2004 Druitt
6,776,314 B2 8/2004 Odet
6,779,672 B2 8/2004 Kano
6,793,101 B2 9/2004 Shinozaki
6,889,857 B2 5/2005 Francois
6,991,123 B2 1/2006 Druitt
7,014,055 B2 3/2006 Kano
D530,603 S 10/2006 Lohrman
D547,184 S 7/2007 Kim
7,308,988 B2 12/2007 Yashima
7,344,039 B2 3/2008 Bixler
7,451,898 B2 11/2008 Seidita
D588,915 S 3/2009 Lohrman
7,503,468 B2 3/2009 Druitt
7,607,547 B2 10/2009 Kumata
7,637,384 B2 12/2009 Price
D608,199 S 1/2010 Gross
D610,454 S 2/2010 Lohrman
7,832,579 B2 11/2010 Lohrman
7,942,287 B2 5/2011 King
7,975,864 B2 7/2011 Druitt
8,453,866 B2 6/2013 Kamath
8,485,374 B2 7/2013 Gevers
8,763,380 B2 7/2014 Sata
8,807,360 B2 8/2014 Erspamer
9,085,385 B1 7/2015 Costanzo
9,126,726 B2 9/2015 Edie
D847,633 S 5/2019 Berge
D871,904 S 1/2020 Berge
D871,905 S 1/2020 Kim
11,021,302 B2 6/2021 Edie
2001/0011649 A1 8/2001 Fujie
2001/0015355 A1 8/2001 Adams
2001/0027957 A1 10/2001 Kano
2002/0030031 A1 3/2002 Druitt
2002/0066713 A1 6/2002 Ma
2002/0134747 A1 9/2002 Babcock
2003/0116523 A1 6/2003 Druitt
2004/0060893 A1 4/2004 Kano
2004/0065665 A1 4/2004 Mahdi
2004/0155007 A1 8/2004 Hearld
2004/0238478 A1 12/2004 Druitt
2005/0189312 A1 9/2005 Bixler
2005/0252878 A1 * 11/2005 Babcock ..... B65D 41/3428 215/252
2006/0163193 A1 7/2006 Smeyak
2006/0255003 A1 11/2006 Fuchs
2007/0125785 A1 6/2007 Robinson
2007/0131641 A1 6/2007 Higgins
2008/0087625 A1 4/2008 Kumata
2009/0045158 A1 2/2009 Suriol

(56) References Cited

U.S. PATENT DOCUMENTS

| | | | | |
|---|---|---|---|---|
| 2009/0057261 | A1* | 3/2009 | Ma | B65D 41/3428 215/252 |
| 2009/0159555 | A1 | 6/2009 | Druitt | |
| 2011/0011821 | A1 | 1/2011 | Lohrman | |
| 2017/0349336 | A1 | 12/2017 | Sadiq | |
| 2018/0009979 | A1 | 1/2018 | Nishiyama | |

FOREIGN PATENT DOCUMENTS

| | | | | | |
|---|---|---|---|---|---|
| GB | 1 054 308 | A | | 1/1967 | |
| GB | 2 068 912 | A | | 8/1980 | |
| GB | 1 593 072 | | | 7/1981 | |
| GB | 2308353 | A | * | 6/1997 | B65D 41/0471 |
| GB | 2 311 060 | A | | 9/1997 | |
| JP | 11059791 | A | * | 3/1999 | B65D 41/3423 |
| JP | 2011-114313 | A | | 6/2011 | |
| KR | 100855086 | B1 | * | 8/2008 | |
| WO | WO 2002/076839 | A2 | | 10/2002 | |
| WO | WO 2009/073137 | A1 | | 6/2009 | |

* cited by examiner

PACKAGE WITH CLOSURE

FIELD OF THE INVENTION

The present invention relates generally to a package with a closure. More specifically, the present invention relates to a package with a polymeric closure with tamper-evidence.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. This visual indication typically divides the closure into two separate components after the tamper-evident feature has been broken. The top portion of the closure is then removed from the container to gain access to the contents of the containers.

One drawback to manufacturing these tamper-evident closures is the complexity involved. Specifically, the manufacturing process for forming folding tamper-evident bands typically includes folding and scoring machinery as a downstream operation. This adds to the initial tooling cost for manufacturing the closure as well as additional processing time. The folding of the tamper-evident bands also has limitations related to the tamper-evident band unfolding before, during and after application. For example, with large diameter closures, it is more difficult to keep the tamper-evident band from unfolding (i.e., it unfolds easier). These folding and unfolding steps also can potentially hamper the effectiveness of the tamper-evident band. By reducing the manufacturing steps involved with folding and unfolding, the process can become more reliable because of the reduced number of secondary operations.

It would be desirable to provide a package with a closure that overcomes the disadvantages of existing tamper-evident closures, while still performing desirable properties of a closure including securely positioning the closure on a container.

SUMMARY

According to one aspect of the present disclosure, a package includes a container and a closure. The container has a neck portion defining an opening. The neck portion has an exterior surface and an interior surface. The container has an external thread formation and a plurality of catch lugs being located on the exterior surface of the neck portion. The closure is configured for fitment to the neck portion of the container for closing the opening. The closure comprises a first closure portion and a second closure portion. The first closure portion includes a polymeric top wall portion and a polymeric annular skirt portion. The polymeric annular skirt portion depends from the polymeric top wall portion. The polymeric annular skirt portion includes an internal thread formation for mating engagement with the external thread formation of the container. The second closure portion includes a polymeric tamper-evident band depending from and being partially detachably connected to the polymeric annular skirt portion by a frangible connection. The frangible connection extends around the circumference of the closure. The second closure portion has an exterior surface and an interior surface. The interior surface of the second closure portion includes a plurality of catch teeth. At least one of the plurality of catch lugs of the container is configured to mechanically catch and lock with a respective one of the plurality of catch teeth of the second closure portion so as to prevent or inhibit the second closure portion from being removed during the opening of the container.

According to a configuration of the above implementation, the container further includes a retention channel. The retention channel is located on the exterior surface of the neck portion. The retention channel is located between the external thread formation and the plurality of catch lugs. The closure further includes a plurality of retention tabs. The plurality of retention tabs is located on the interior surface of the second closure portion. The plurality of retention tabs is located between the frangible connection and the plurality of catch teeth. The plurality of retention tabs of the closure is configured to engage with the retention channel of the container.

According to another configuration of the above implementation, the neck portion of the container further includes a continuous outer ring and an A-collar. The continuous outer ring and the A-collar assist in forming the retention channel.

According to a further configuration of the above implementation, the retention channel extends around the entire circumference of the neck portion of the container.

In a further aspect of the above implementation, the plurality of retention tabs is at an angle of from about 30 to about 60 degrees relative to the tamper-evident band and extends upwardly towards the polymeric top wall portion.

In a further aspect of the above implementation, the closure further includes a liner being located adjacent to an interior surface of the polymeric top wall portion.

In yet a further aspect of the above implementation, the external thread formation of the container is one continuous helical thread, and the internal thread formation of the closure is one continuous helical thread.

In yet a further aspect of the above implementation, each of the plurality of catch teeth has a first end and a second end. Each of the first ends of the plurality of catch teeth has a height and a width greater than a height and a width of the second end. The height and the width of the plurality of catch teeth are tapered from the first end to the second end. In a further implementation, each of the first ends of the plurality of catch teeth has a surface being angled inwardly. Each of the surfaces of the first end of the plurality of catch teeth is configured to mechanically catch and lock with a respective one of the plurality of catch teeth.

In another aspect of the above implementation, each of the plurality of catch lugs has a first end and a second end. Each of the first ends of the plurality of catch lugs has a surface being angled inwardly. Each of the first ends of the plurality of catch lugs has a height and a width greater than a height and a width of the second ends. The height and the width of the plurality of catch lugs are tapered from the first end to the second end.

According to a configuration of the above implementation, the number of catch teeth is from about 4 to about 20, and the number of catch lugs is from about 4 to about 20. In another implementation, the number of catch teeth is from about 6 to about 18, and the number of catch lugs is from about 6 to about 18.

According to a configuration of the above implementation, each of the plurality of catch lugs of the container is configured to mechanically catch and lock with a respective one of the plurality of catch teeth of the second closure portion so as to prevent or inhibit the second closure portion from being removed during the opening of the container.

According to another aspect of the present disclosure, a package includes a container and closure. The container has a neck portion defining an opening. The neck portion has an exterior surface and an interior surface. The container has an external thread formation, a plurality of catch lugs, and a retention channel being located on the exterior surface of the neck portion. The retention channel is located between the external thread formation and the plurality of catch lugs. The closure is configured for fitment to the neck portion of the container for closing the opening. The closure comprises a first closure portion and a second closure portion. The first closure portion includes a polymeric top wall portion and a polymeric annular skirt portion. The polymeric annular skirt portion depends from the polymeric top wall portion. The polymeric annular skirt portion includes an internal thread formation for mating engagement with the external thread formation of the container. The second closure portion includes a polymeric tamper-evident band depending from and being partially detachably connected to the polymeric annular skirt portion by a frangible connection. The frangible connection extends around the circumference of the closure. The second closure portion has an exterior surface and an interior surface. The interior surface of the second closure portion includes a plurality of catch teeth and a plurality of retention tabs. The plurality of retention tabs is located between the frangible connection and the plurality of catch teeth. At least one of the plurality of catch lugs of the container is configured to mechanically catch and lock with respective one of the plurality of catch teeth of the second closure portion so as to prevent or inhibit the second closure portion from being removed during the opening of the container. The plurality of retention tabs of the closure is configured to engage with the retention channel of the container. The number of catch teeth is from about 4 to about 20, and the number of catch lugs is from about 4 to about 20.

According to a further configuration of the above implementation, the neck portion of the container further includes a continuous outer ring and an A-collar. The continuous outer ring and the A-collar assist in forming the retention channel. The retention channel may extend around the entire circumference of the neck portion of the container.

In a further aspect of the above implementation, the plurality of retention tabs is at an angle of from about 30 to about 60 degrees relative to the tamper-evident band and extends upwardly towards the polymeric top wall portion.

In a further aspect of the above implementation, each of the plurality of catch teeth has a first end and a second end. Each of the first ends of the plurality of catch teeth has a height and a width greater than a height and a width of the second end. The height and the width of the plurality of catch teeth are tapered from the first end to the second end.

In yet a further aspect of the above implementation, each of the first ends of the plurality of catch teeth has a surface being angled inwardly. Each of the surfaces of the first end of the plurality of catch teeth is configured to mechanically catch and lock with a respective one of the plurality of catch teeth.

In yet a further aspect of the above implementation, each of the plurality of catch lugs has a first end and a second end. Each of the first ends of the plurality of catch lugs has a surface being angled inwardly. Each of the first ends of the plurality of catch lugs has a height and a width greater than a height and a width of the second ends. The height and the width of the plurality of catch lugs are tapered from the first end to the second end.

In yet a further aspect of the above implementation, each of the plurality of catch lugs of the container is configured to mechanically catch and lock with a respective one of the plurality of catch teeth of the second closure portion so as to prevent or inhibit the second closure portion from being removed during the opening of the container.

According to another aspect of the present disclosure, a package includes a container and a closure. A container is provided and has a neck portion defining an opening. The neck portion has an exterior surface and an interior surface. The container has an external thread formation and a plurality of catch lugs being located on the exterior surface of the neck portion. A closure is provided and includes a first closure portion and a second closure portion. The first closure portion includes a polymeric top wall portion and a polymeric annular skirt portion. The polymeric annular skirt portion depends from the polymeric top wall portion. The polymeric annular skirt portion includes an internal thread formation for mating engagement with the external thread formation of the container. The second closure portion includes a polymeric tamper-evident band depending from and being partially detachably connected to the polymeric annular skirt portion by a frangible connection. The frangible connection extends around the circumference of the closure. The second closure portion has an exterior surface and an interior surface. The interior surface of the second closure portion includes a plurality of catch teeth. At least one of the plurality of catch lugs of the container is configured to mechanically catch and lock with a respective one of the plurality of catch teeth of the second closure portion so as to prevent or inhibit the second closure portion from being removed during the opening of the container. The closure is placed onto the neck portion of the container in the absence of an unfolding step of the tamper-evident band.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
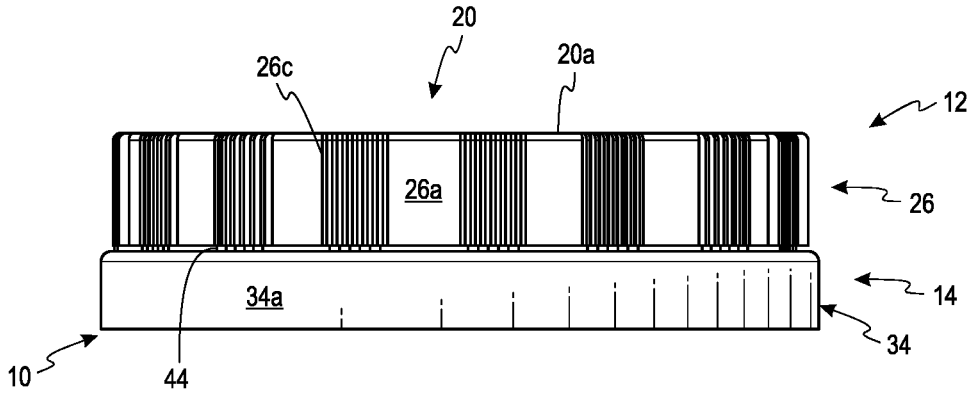
FIG. 1A is a front view of a closure according to one embodiment.
Figure 1B:
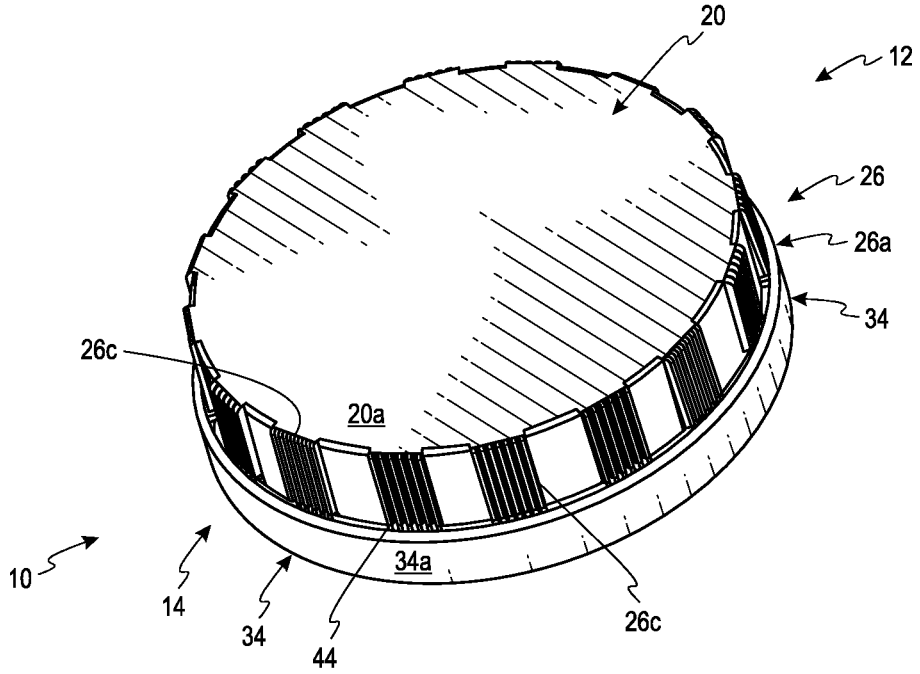
FIG. 1B is a top perspective view of the closure of FIG. 1A.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 7A:
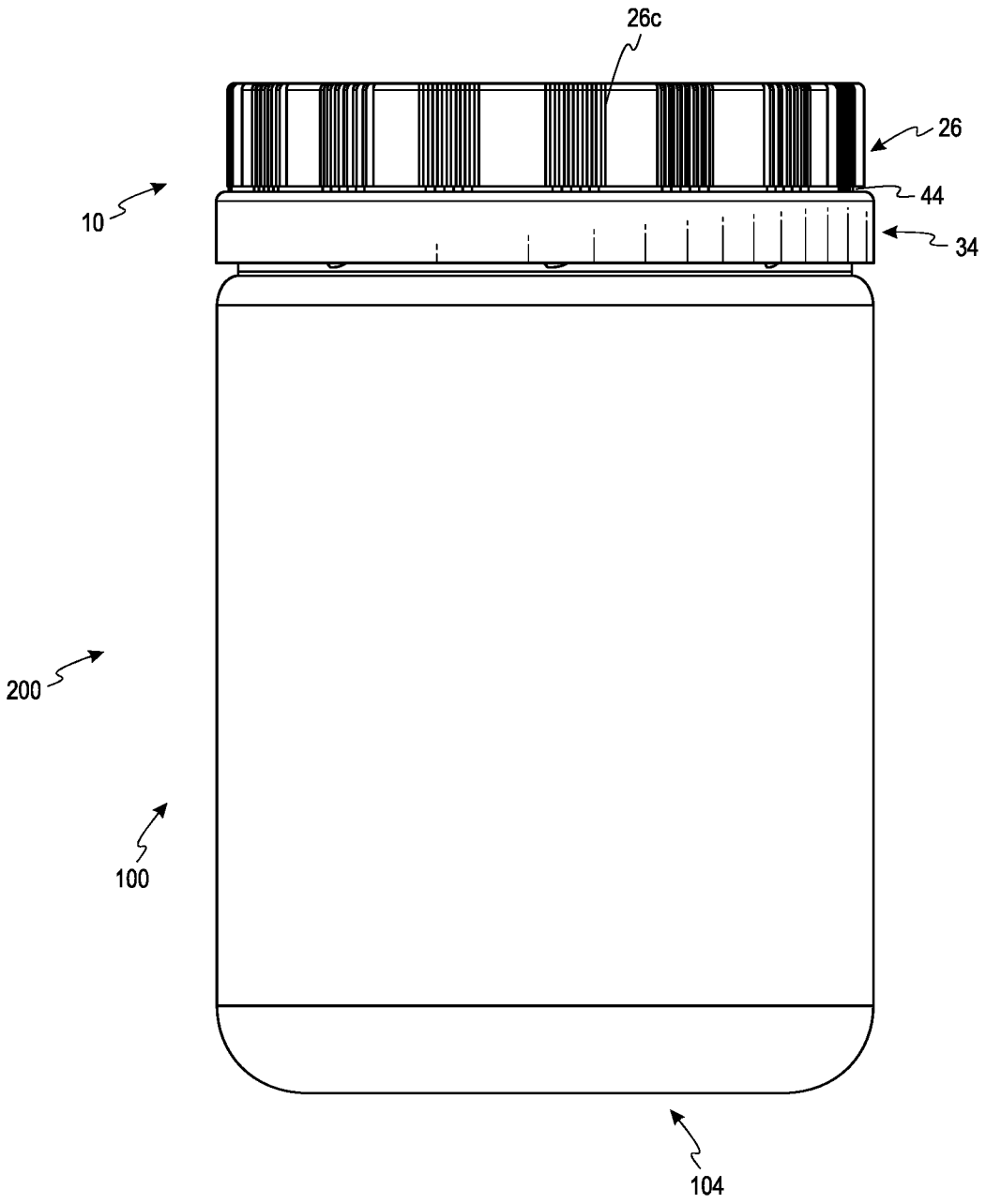
FIG. 7A is a front perspective view of a package including the closure of FIG. 1A and the container of FIG. 4A.
Figure 7B:
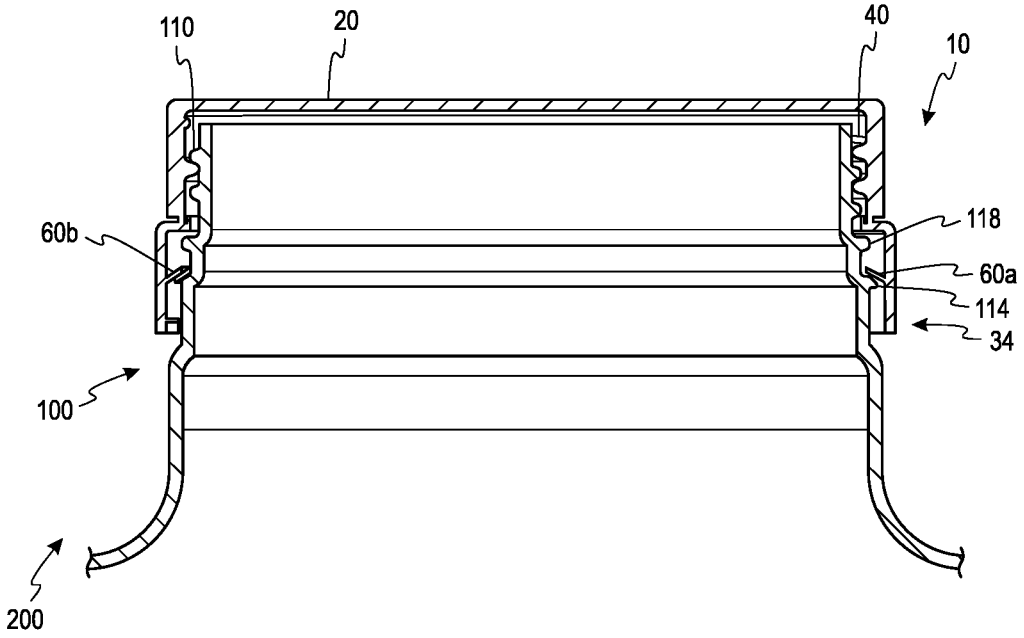
FIG. 7B is a generally cross-sectional view of a neck portion of the package of FIG. 7A.

Referring to FIGS. 1A-1D, a polymeric closure 10 according to one embodiment is shown. The polymeric closure 10 is configured to be used with a container 100 that is shown in FIGS. 4A-4D. The polymeric closure 10 and the container 100 form a package 200 that is shown in FIGS. 7A, 7B.

The package of the present invention is advantageous since it eliminates the need for folding/unfolding a tamper-evident band of a closure during the processing before the closure is applied to a neck portion of a container. This folding/unfolding adds to the initial tooling costs for manufacturing the closure and also adds processing time. Furthermore, by eliminating the in-line folding step, the effectiveness or design considerations of the tamper-evident band can be improved. Specifically, the various properties of the closure can be improved because of eliminating the need to design the tamper-evident band for folding/unfolding. The process of forming the closure also should have improved reliable because of eliminating various process steps.

The closure is configured for fitment to the neck portion of the container for closing and opening of the container. Referring back to FIGS. 1A-1D, the polymeric closure 10 includes a first closure portion or lid 12 and a second closure portion or base 14. The polymeric closure 10 shown in FIGS. 1A-1D is a two-piece closure. The first closure portion 12 and the second closure portion 14 are adapted to be twisted and then separated from each other as will be discussed below. It is contemplated that the closure may be a one-piece closure in another embodiment. In such an embodiment, a liner would not be included in the polymeric closure.

Figure 1C:
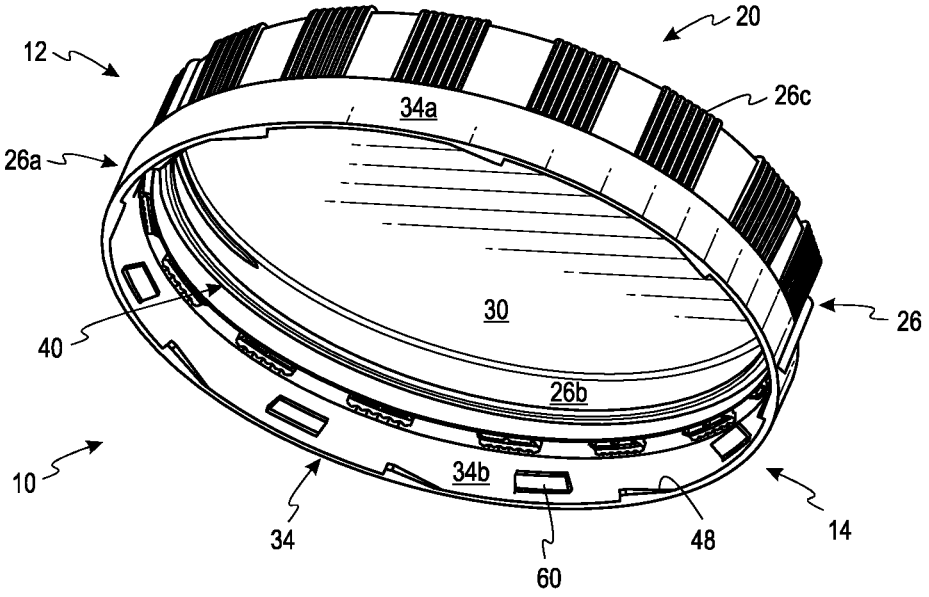
FIG. 1C is a bottom perspective view of the closure of FIG. 1A.
Figure 1D:
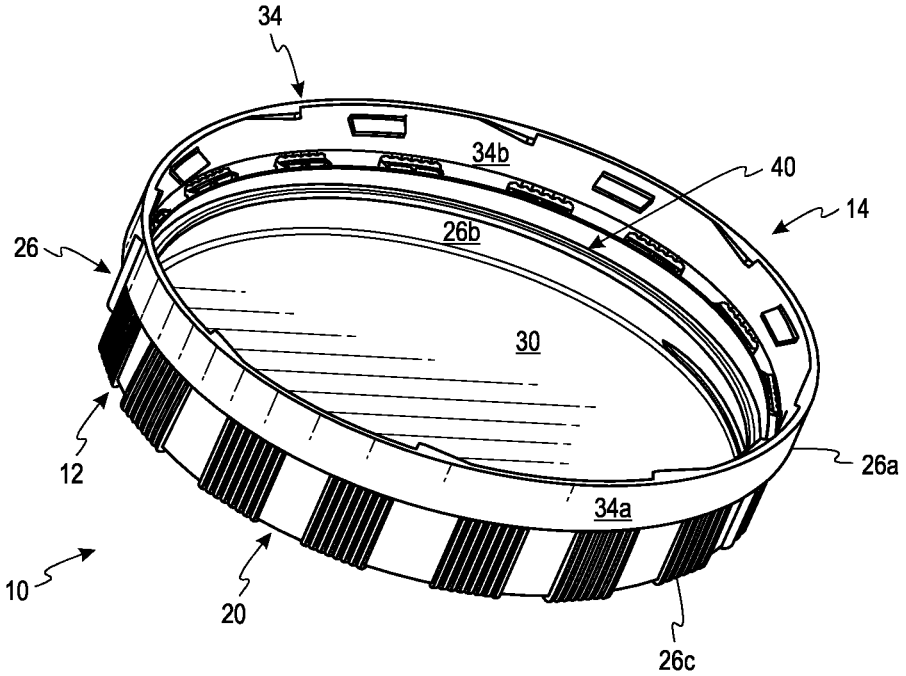
FIG. 1D is another bottom perspective view of the closure of FIG. 1A.

The first closure portion 12 includes a polymeric top wall portion 20, a polymeric annular skirt portion 26 and a liner 30 (see FIGS. 1C, 1D). The polymeric top wall portion 20 has an exterior surface 20*a* and an interior surface. The polymeric annular skirt portion 26 depends from the polymeric top wall portion 20. The polymeric annular skirt portion 26 has an exterior surface 26*a* and an interior surface 26*b*. The second closure portion 14 includes a polymeric tamper-evident band 34. The polymeric tamper-evident band 34 depends from and is partially detachably connected to the polymeric annular skirt portion 26 by a frangible connection 44 (FIG. 1A).

The liner 30 of FIGS. 1C, 1D is located adjacent to the interior surface of the polymeric top wall portion 20. The liner 30 is typically made of compressible polymeric material and provides sealing for the polymeric closure 10. In one embodiment, the liner is a polymeric foam liner. The polymeric foam liner may be a polyethylene foam in one embodiment. The polyethylene foam may be combined with a polytetrafluoroethylene (PTFE) layer in another embodiment to form a two-layered liner. It is contemplated that the liner may comprise other polymeric foam material or non-foam materials.

In other embodiments, other sealing mechanisms can be used in conjunction with the polymeric closure. For example, in one embodiment, a first closure portion further includes a polymeric continuous plug seal and/or an outer seal. The polymeric continuous plug seal and/or the outer seal depend from the polymeric top wall portion and provide a sealing mechanism. The continuous plug seal is typically spaced from an interior surface of the polymeric annular skirt portion. The outer seal provides an outer seal with respect to an outer finish surface of a container. It is contemplated that other sealing mechanisms may be used in the polymeric closure.

Referring specifically to FIGS. 1C, 1D, the polymeric annular skirt portion 26 includes an internal thread formation 40 for mating engagement with an external thread formation of the container 100. The internal thread formation 40 is located on the interior surface 26*b* of the polymeric annular skirt portion 26. The internal thread formation 40 is one continuous helical thread in this embodiment. It is contemplated that the internal helical thread formation may be discontinuous.

In another embodiment, the internal thread formation includes a first closure lead and a second closure lead, which are referred collectively as a double lead closure thread. Each of the first and second closure leads may be continuous. The first and second helical closure leads may be helical. The first positions of the first and second closure leads are often located roughly 180 degrees apart from each other and, thus, begin on generally opposing sides of the closure. It is contemplated that the first and second closure leads may be discontinuous.

It is also contemplated that the internal thread formation of the closure may differ from a helical thread formation. It is also contemplated that other internal thread formations may be used in the closure. For example, the internal thread formation may include a triple-threaded structure having first, second and third closure leads.

Referring back to FIGS. 1A-1D, the exterior surface 26*a* of the polymeric annular skirt portion 26 may also include a plurality of ridges 26*c* thereon. The plurality of ridges 26*c* assists a user in gripping when moving the polymeric closure 10 between closed and open positions. The plurality of ridges 26*c* is in spaced sections along the outer periphery of the polymeric closure 10. Thus, the plurality of ridges 26*c* is intermittently spaced around the outer periphery of the polymeric closure 10. It is contemplated that the ridges, if used, may be continuous around the periphery of the polymeric closure.

The polymeric closure 10 of FIG. 1A includes the frangible connection 44 that depends from and is partially detachably connected to the polymeric annular skirt portion 26 and the tamper-evident band 34. The frangible connection 44 in this embodiment extends from the plurality of ridges 26*c* to partially detachably connect to the polymeric annular skirt portion 26 and the tamper-evident band 34. The frangible connection 44 may be formed by molded-in-bridges in one embodiment. In this embodiment, the molded-in-bridges are formed using a feature in the mold. The frangible connection 44 is in the form of scoring or scored lines, notches, leaders, nicks or other lines of weaknesses. The frangible connection in this embodiment extends intermittently around the entire circumference of the closure, and desirably extends completely around the circumference of the closure. In this embodiment, a gap is formed between the polymeric annular skirt portion 26 and the tamper-evident band 34 where the plurality of ridges 26*c* are not present. It is contemplated that the frangible connection may be formed in other manners in the polymeric closure.

In another method, the frangible connection is formed by a slitting technology that is independent from the formation of the remainder of the polymeric closure. The frangible connection is formed using scoring or scored lines, notches, leaders, nicks or other lines of weaknesses.

Referring back to FIGS. 1A-1D, the second closure portion 14 includes the polymeric tamper-evident band 34. The polymeric tamper-evident band 34 is located at the bottom thereof (i.e., an end opposite of the polymeric top wall portion 20). The tamper-evident band 34 depends from and is at least partially detachably connected to the polymeric annular skirt portion 26 by the frangible connection 44. As viewed in FIG. 1A, the polymeric tamper-evident band 34 is a lower tamper-evident feature. The tamper-evident band 34 works in conjunction with the container to indicate to a user that the contents of the container may have been accessed. More specifically, the tamper-evident band 34 is designed to at least partially separate and more desirably fully separated from the annular skirt portion 26 when a user opens the package by twisting the first closure portion 12 with respect to the second closure portion 14. This breaks the frangible connection and allows a user to unthread the polymeric closure 10 with respect to the container 100.

The polymeric tamper-evident band 34 has an exterior surface 34*a* and an interior surface 34*b* (FIGS. 1C, 1D). As shown in FIGS. 1C, 1D, the interior surface 34*b* of the polymeric tamper-evident band 34 includes a plurality of catch teeth 48 and a plurality of retention tabs 60. As will be discussed below, the plurality of catch teeth 48 of the closure 10 is configured to engage with a respective one of a plurality of catch lugs of the container to prevent or inhibit the second closure portion 14 from being removed during the opening of the container 100 (i.e., a twisting of the polymeric closure 10 with respect to the container 100 that breaks the frangible connection 44).

Figure 2A:
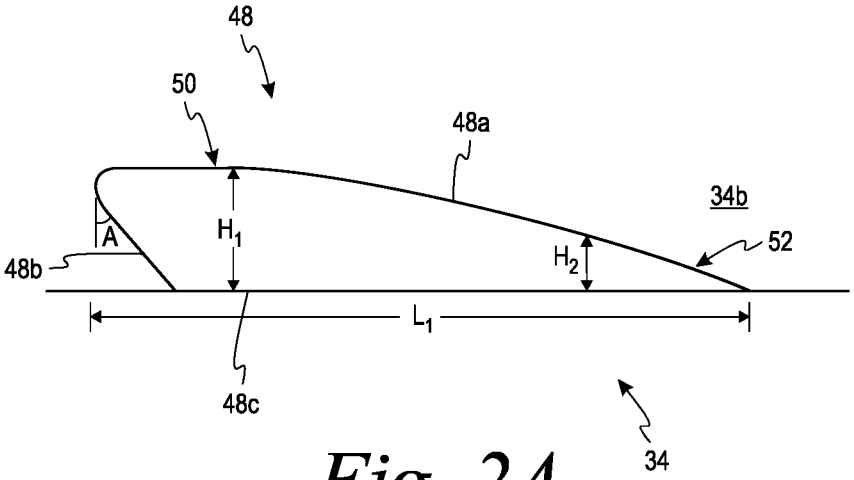
FIG. 2A is an enlarged front view of one of the plurality of catch teeth according to one embodiment.
Figure 2B:
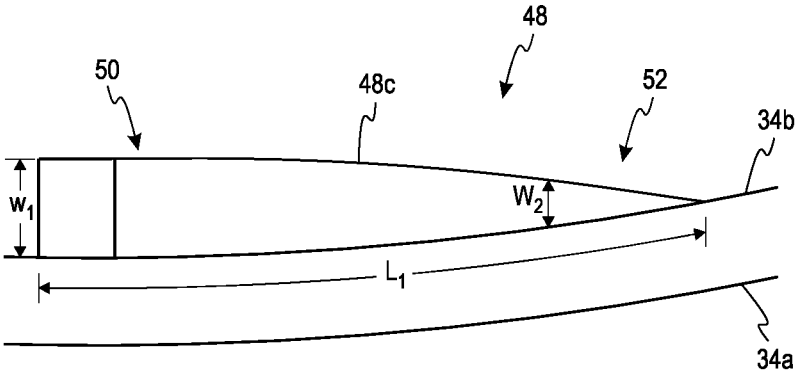
FIG. 2B is an enlarged bottom view of the catch teeth of FIG. 2A.

An enlarged view of one of the plurality of catch teeth 48 is shown in FIGS. 2A, 2B. The plurality of catch teeth 48 extends from the interior surface 34*b* of the polymeric tamper-evident band 34 inwardly to an interior center of the polymeric closure 10. Referring to FIGS. 2A, 2B, the catch teeth 48 includes a tapered top surface 48*a* that gradually tapers into the interior surface 34*b* of the polymeric tamper-evident band 34. The tapered top surface 48*a* extends generally from a first end 50 to a second end 52. The tapered top surface 48*a* assists in allowing the catch teeth 48 of the polymeric closure 10 to initially clear the catch lugs of the container more easily during initially placement/threading of the polymeric closure 10 onto the container 100. By providing less material in the tapered top surface 48*a* at the second end 52 reduces the initial resistance caused by the surface interaction between the closure 10 (catch teeth) and the container 100 (catch lugs) during the threading process. This tapering is shown by the difference in height H1 at the first end 50 and height H2 at the second end 52 of the catch teeth 48.

The first end 50 of the catch teeth 48 includes a surface 48*b* that is initially chamfered and then angled inwardly. The surface 48*b* is configured to engage and lock with a respective one of the plurality of catch lugs as will be discussed below. By having the first end 50 of the catch teeth 48 angled inwardly assists in engaging and locking with a respective one of the catch lugs of the container. As shown in FIG. 2A, the surface 48*b* at the first end 50 is generally at an angle A of from about 5 to about 50 degrees. The surface 48*b* of the first end 50 in another embodiment is from an angle from about 10 to about 45 degrees, or from about 20 to about 40 degrees.

The width of the catch teeth 48 also decreases from the first end 50 to the second end 52. Specifically, width W1 of FIG. 2B is greater at the first end 50 than width W2 at the second end 52. More specifically, the surface 48*c* is tapered from the first end 50 to the second end 52. By providing less material at the second end 52 reduces the initial resistance caused by the surface interaction between the closure 10 (catch teeth) and the container 100 (catch lugs) during the threading process.

The dimensions of the catch teeth often vary with the diameter of the closure. The length L1 of the catch teeth is generally from about 0.2 to about 0.75 inch. The length L1 of the catch teeth is from about 0.3 to about 0.5 inch in another embodiment. The height H1 of the catch teeth is generally from about 0.05 to about 0.10 inch. The height H1 of the catch teeth is from about 0.06 to about 0.09 inch in another embodiment. The width W1 of the catch teeth is generally from about 0.02 to about 0.063 inch. The width W1 of the catch teeth is from about 0.03 to about 0.06 inch in another embodiment.

The plurality of catch teeth 48 as shown in FIGS. 1C and 1D are spaced intermittently along the interior surface 34*b* of the polymeric tamper-evident band 34. In this embodiment, there are exactly eight catch teeth 48 spaced intermittently along the interior surface 34*b* of the polymeric tamper-evident band 34. It is contemplated that there may be more or less catch teeth in a polymeric closure. The number of catch teeth in a polymeric closure is from about 4 to about 20 in one embodiment. The number of catch teeth in a polymeric closure is from about 6 to about 18 in another embodiment. The number of catch teeth in a polymeric closure is from about 8 to about 16 in a further embodiment.

It is contemplated that the catch teeth may be shaped or sized differently from that shown in FIGS. 2A, 2B. The catch teeth, however, need to be configured in conjunction with the catch lugs to mechanically catch and lock together, while at the same time allowing clearance from the catch lugs during the placing of the closure onto the container.

Figure 3:
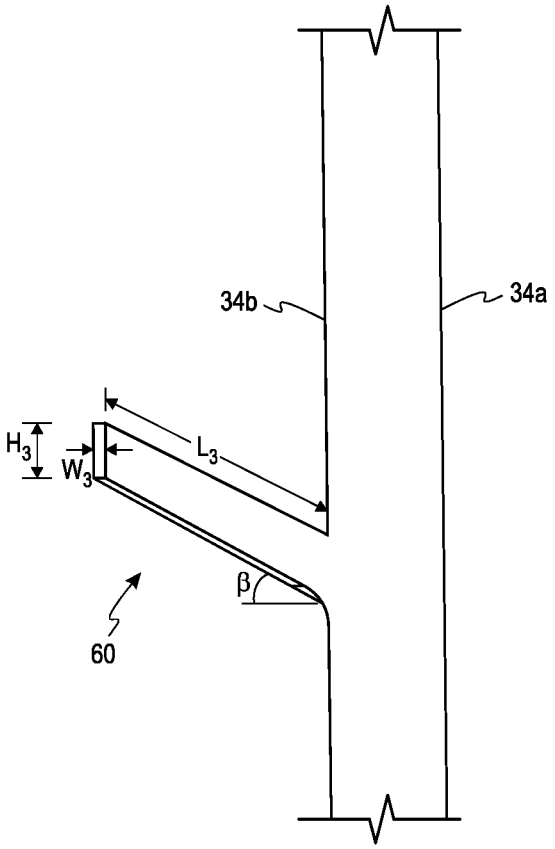
FIG. 3 is an enlarged side view of one of the plurality of retention tabs extending from an annular skirt portion according to one embodiment.

An enlarged view of one of the plurality of retention tabs 60 is shown in FIG. 3. The retention tabs 60 extend inwardly and upwardly from the interior surface 34*b* of the polymeric tamper-evident band 34. More specifically, the retention tabs 60 extend inwardly towards an interior center of the polymeric closure 10 and upwardly towards the polymeric top wall portion 20. The plurality of retention tabs 60 is shaped and sized to assist in fitting into a retention channel of the container as will be discussed below. The plurality of retention tabs in conjunction with the retention channel of the container assists in preventing or inhibiting axial movement of the closure 10 with respect to the container 100 in the absence of twisting that break the frangible connections.

The retention tab 60 as shown in FIG. 3 extends generally upwardly and outwardly from the interior surface 34*b* of the polymeric tamper-evident band 34. The upward direction of the retention tab 60 is in the direction towards the polymeric top wall portion 20, which is not shown in FIG. 3. The angle (angle B in FIG. 3) of the retention tab 60 relative to the tamper-evident band 34 is generally from about 30 to about 60 degrees. In another embodiment, the upward angle (angle B in FIG. 3) of the retention tab 60 is from about 35 to about 55 degrees.

The length L3 of the retention tab 60 is generally from about 0.013 to 0.38 inch. The length L3 of the retention tab 60 is from about 0.02 to about 0.03 inch in another embodiment. The height H3 of the retention tab 60 is generally from about 0.015 to about 0.035 inch. The height H3 of the retention tab 60 is from about 0.020 to about 0.030 inch in another embodiment. The width W3 of the retention tab 60 is generally from about 0.02 to about 0.063 inch. The width W3 of the retention tab 60 is from about 0.03 to about 0.06 inch in another embodiment.

The retention tabs 60 are located between the internal thread formation 40 and the plurality of catch teeth 48 in the polymeric closure 10. The retention tabs 60 shown in FIGS. 1C, 1D are spaced intermittently along the interior surface 34*b* of the polymeric tamper-evident band 34. In this embodiment, there are exactly eight retention tabs 60 spaced intermittently along the interior surface 34*b* of the polymeric tamper-evident band 34. It is contemplated that there may be more or less retention tabs formed in the polymeric closure. The number of retention tabs in a polymeric closure is from about 6 to about 18 in one embodiment. The number of retention tabs in a polymeric closure is from about 8 to about 16 in another embodiment.

It is contemplated that the retention tabs may be shaped or sized differently from that shown in FIG. 3. The retention tabs, however, need to be configured to engage with the retention channel as will be discussed below.

The closures may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/0009979, U.S. Publication No. 2017/0349336, U.S. Pat. Nos. 9,126,726, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

A container is used with a closure. A container has a neck portion defining an opening. The neck portion has an exterior surface and an interior surface. The container has an external thread formation on the neck portion and a plurality of catch lugs being located on the exterior surface of the neck portion.

Referring to FIGS. 4A-4D, a container 100 is shown that includes a neck portion 102 defining an opening 106. The opening 106 is located opposite of a bottom 104 of the container. The neck portion 102 of the container 100 includes an external thread formation 110, an A-collar 114, a continuous outer ring 118, a plurality of catch lugs 120 and a retention channel 130. The A-collar 114 prevents or inhibits the tamper-evident band 34 from being removed after the frangible connection 44 is broken. More specifically, the A-collar 114 prevents or inhibits the polymeric tamper-evident band 34 from being removed in an axially direction (direction away from the bottom 104 of the container 100). The continuous outer ring 118 assists in forming the retention channel 130 and retaining the retaining tabs 60 therein as will be discussed below.

Figure 4A:
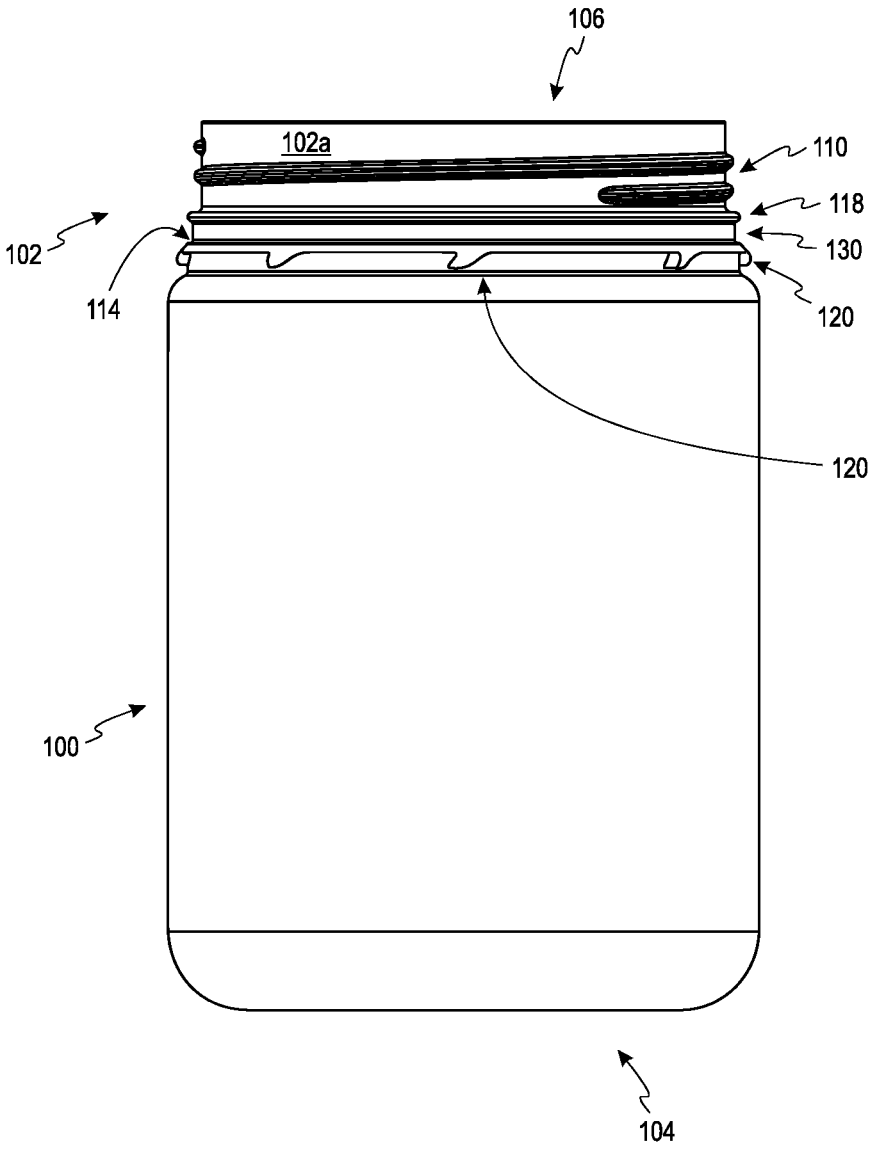
FIG. 4A is a side view of a container according to one embodiment.
Figure 4B:
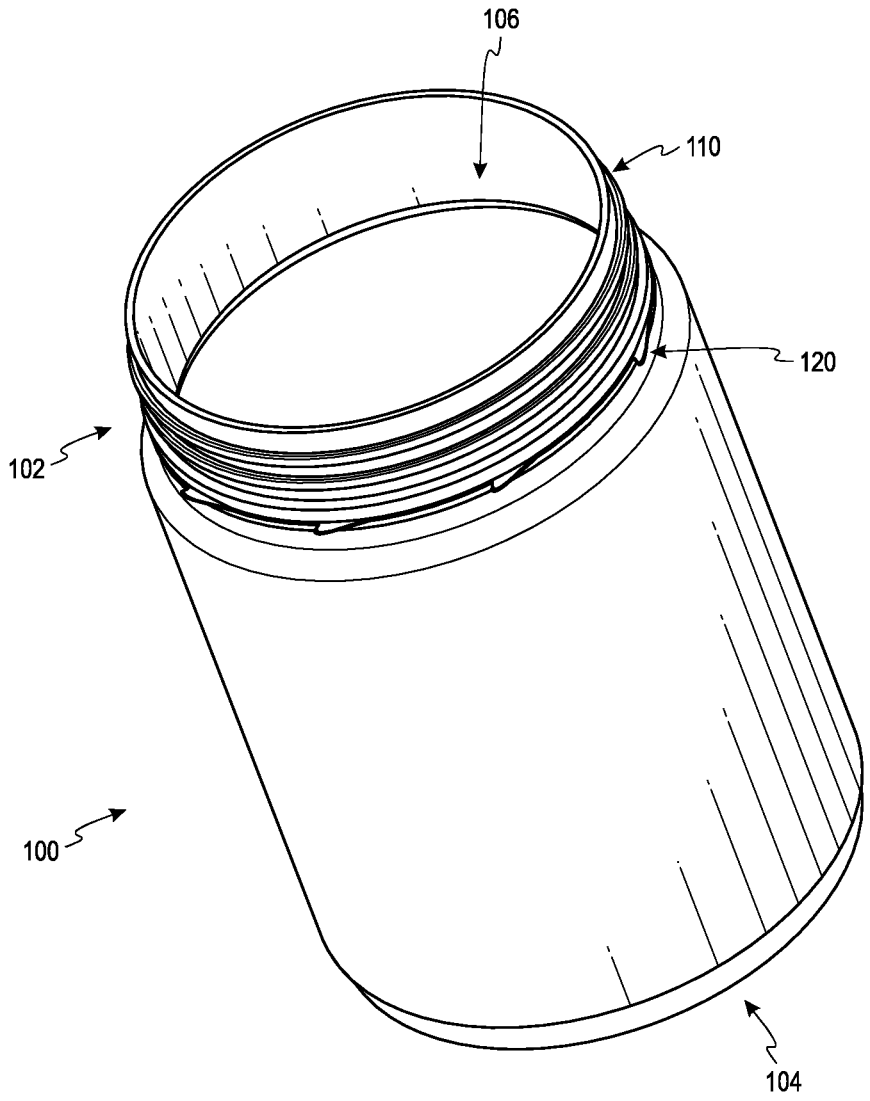
FIG. 4B is a top perspective view of the container of FIG. 4A.
Figure 4C:
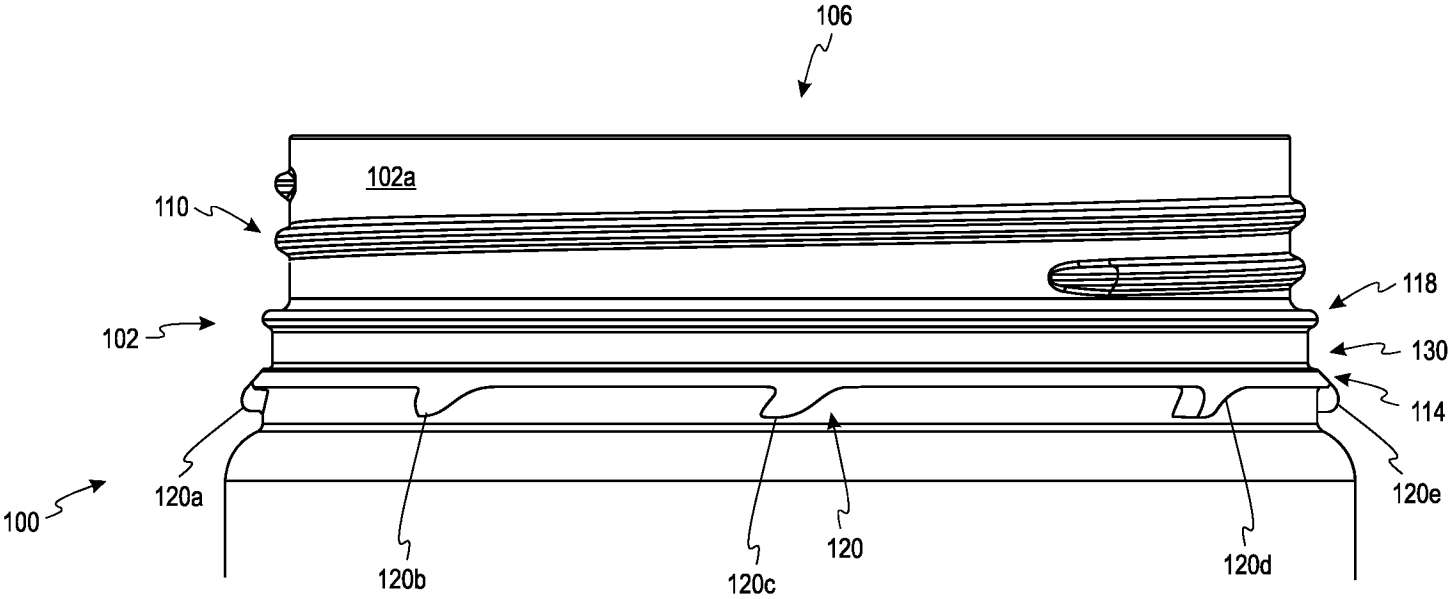
FIG. 4C is an enlarged side view of a finish of the container of FIG. 4A.

Referring to FIG. 4C, the external thread formation 110 of the container 100 is for mating engagement with the internal thread formation 40 of the polymeric closure 10. The external thread formation 110 is one continuous helical thread in this embodiment.

In another embodiment, the external thread formation includes a first container lead and a second container lead, which are referred collectively as a double lead container thread. Each of the first and second container leads may be continuous. The first and second helical container leads may be helical. The first positions of the first and second container leads are often located roughly 180 degrees apart from each other and, thus, begin on generally opposing sides of the container. It is contemplated that the first and second container leads may be discontinuous.

It is also contemplated that the external thread formation of the container may differ from a helical thread formation. It is also contemplated that other external thread formations may be used in the container. For example, the external thread formation may include a triple-threaded structure having first, second and third container leads.

Referring still to FIG. 4C, a portion of the plurality of catch lugs 120 is shown, which are numbered 120*a*-120*h*. The plurality of catch teeth 48 is configured to mechanically catch and lock together with the a respective one of the plurality of catch lugs 120 to prevent or inhibit the second closure portion 14 from being removed during the opening of the container (i.e., a twisting of the polymeric closure 10 with respect to the container 100 that breaks the frangible connection 44).

Figure 4D:
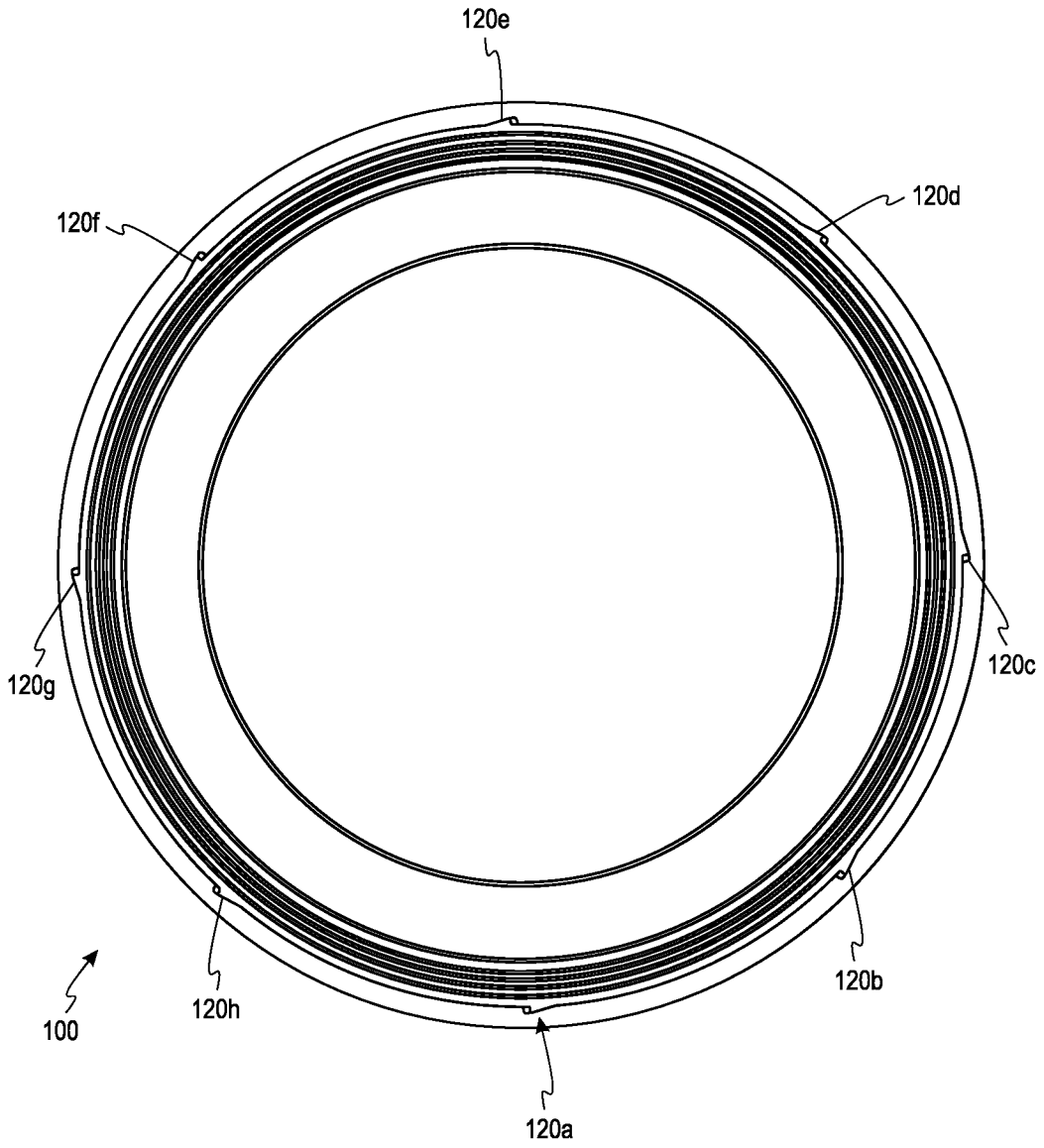
FIG. 4D is a top view of the container of FIG. 4A.

Referring to FIG. 4D, a top view of the container 100 show the plurality of catch lugs 120*a*-120*h* being spaced intermittently along the finish of the container 100. In this embodiment, there are exactly eight catch lugs 120 spaced intermittently around the finish of the container 100. It is contemplated that there may be more or less catch lugs 120 formed in the finish of the container. The number of catch lugs in the finish of the container is from about 4 to about 20 in one embodiment. The number of catch lugs in the finish of the container is from about 6 to about 18 in another embodiment, and from about 8 to about 16 in a further embodiment. The number of catch lugs of the container is typically the same as the number of catch teeth formed in the polymeric closure.

Figure 5A:
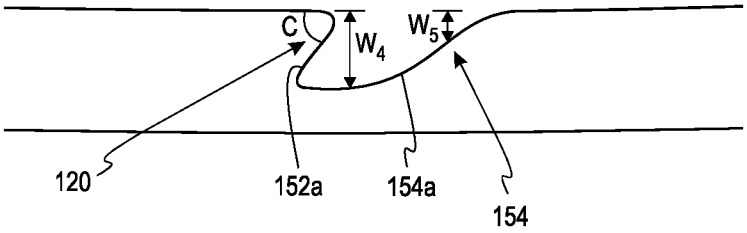
FIG. 5A is an enlarged front view of a catch lug according to one embodiment.
Figure 5B:
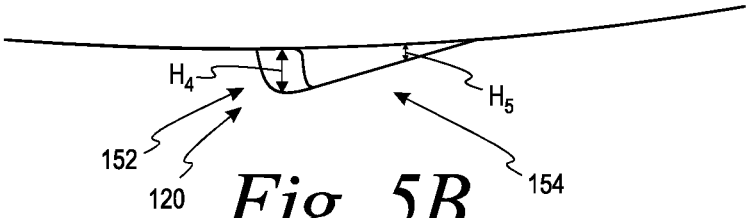
FIG. 5B is an enlarged bottom view of the catch lug of FIG. 5A.

Referring to FIGS. 5A, 5B, one of the plurality of catch lugs 120 is shown. The plurality of catch lugs 120 is located on the exterior surface 102*a* of the neck portion 102 as best shown in FIG. 4A, 4C. Referring back to FIG. 5A, the catch lug 120 has a first end 152 and a second end 154. The first end 152 of the catch lug 120 is configured to engage and lock with a respective one of the catch teeth 48. The first end 152 includes a surface 152*a* that is initially chamfered and then angled inwardly with a steep surface. The surface 152*a* has an angle C of from about 5 to about 50 degrees. In another embodiment, the surface 152*a* has an angle from about 10 to about 45 degrees, and from about 20 to about 40 degrees in a further embodiment. The width of the catch lug decreases from the first end 152 to the second end 154 of the catch lugs 120. A surface 154*a* generally tapers such that a width W4 is greater than a width W5 in FIG. 5A.

Referring to FIG. 5B, the catch lug 120 has a height at the first end 152 that is greater than a height at the second end 154. Specifically, the height H4 is greater than the height H5 in the catch lug 120.

Figure 6:
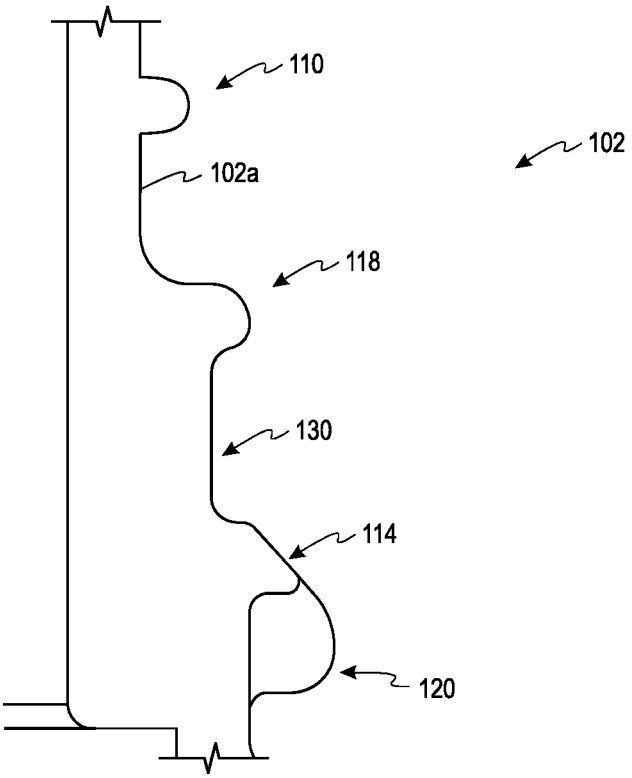
FIG. 6 is an enlarged side view of a retention channel according to one embodiment.

Referring to FIG. 6, a retention channel 130 is shown. The retention channel 130 is located on the exterior surface 102*a* of the neck portion 102 of the container 100. The retention channel 130 is located between the external thread formation 110 and the plurality of catch lugs 120. More specifically, the retention channel 130 is formed between the A-collar 114 and the continuous outer ring 118. The retention channel 130 is continuous and extends entirely around the circumference of the neck portion 102 of the container 100 in this embodiment.

Figure 9:
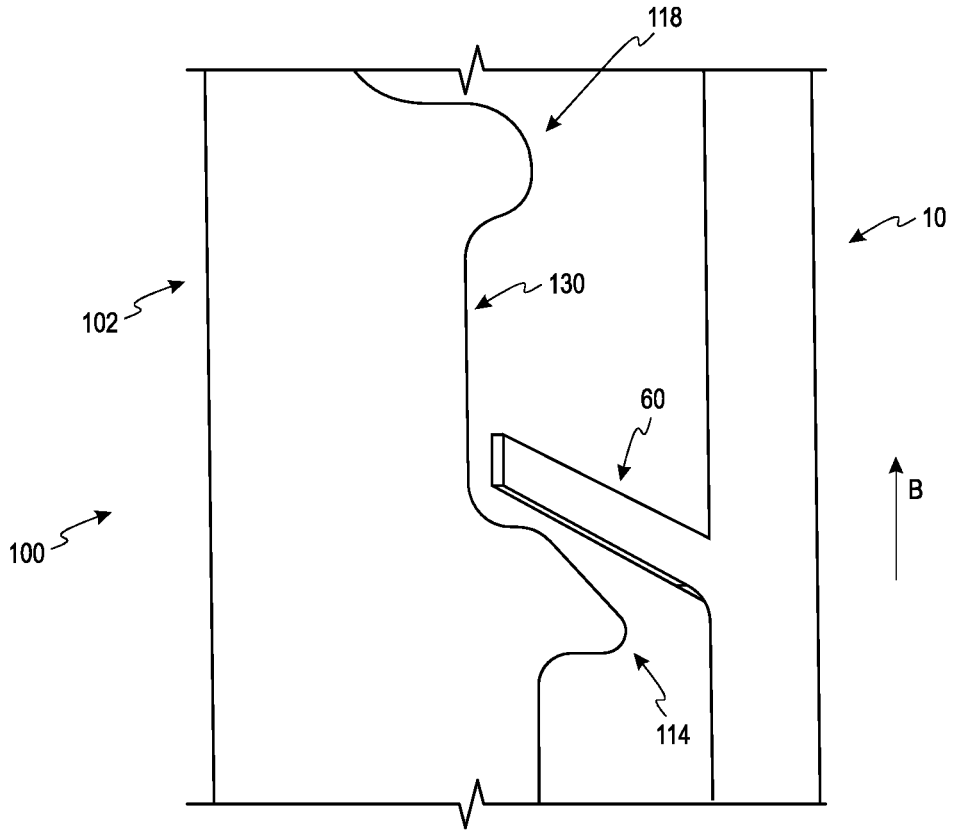
FIG. 9 is a cross-sectional view of the retention tab engaged in the retention channel.

The retention channel 130 is configured to receive and engage with the plurality of retention tabs 60 of the polymeric closure 10 as shown in FIG. 9. Therefore, the retention channel 130 is sized, shaped and positioned to accommodate the corresponding plurality of retention tabs 60 of the closure 10. The retention channel 130 in combination with the continuous outer ring 118 assists in preventing or inhibiting the polymeric closure 10 or a portion of the closure 10 (second closure portion 14) from being removed from the container 100. More specifically, the retention channel 130 in combination with the continuous outer ring 118 assists in preventing or inhibiting the closure 10 or a portion of the closure 10 from moving axially (direction of arrow B in FIG. 9). The direction of arrow B is in a direction away from the bottom 104 of the container 100.

When the polymeric closure 10 is being applied onto the container 100, the plurality of retention tabs 60 will engage with the continuous outer ring 118 and initially flex. As the polymeric closure is continued to be applied onto the container 100, the retention tabs 60 will clear the continuous outer ring 118 and engage fully into the retention channel 130. On separating the first closure portion 12 from the second closure portion 14 via the frangible connection 44, the plurality of retention tabs 60 of the second closure portion 14 continues to engage the retention channel 130 in such a manner that limits the ability of a user to remove the second closure portion 14 due to the interference and mechanical retention of the plurality of retention tabs 60 relative to the retention channel 130.

In one embodiment, a package comprises a container and a closure. The container has a neck portion defining an opening. The neck portion has an exterior surface and an interior surface. The container has an external thread formation on the neck portion and a plurality of catch lugs located on the exterior surface of the neck portion. The closure is configured for fitment to the neck portion of the container for closing the opening. The closures are configured to be placed on a container or bottle that contain product. The product is typically a liquid product, but also may be a solid product or a combination of a liquid and solid product.

One non-limiting example of a closure and a container forming a package is shown in FIGS. 7A, 7B. FIG. 7A is a front perspective view of the package 200 including the polymeric closure 10 of FIG. 1A-1D and the container 100 of FIG. 4A-4D. FIG. 7B is a generally cross-sectional view of the neck portion 102 and the closure 10 of the package 200 of FIG. 7A. FIGS. 7A, 7B show the package 200 in an unopened position or state.

FIG. 7B is a cross-sectional view of the package 200 including the polymeric closure 10 of FIG. 1A-1D and the container 100 of FIG. 4A-4D. The interaction of the internal thread formation 40 of the polymeric closure 10 with the external thread formation 110 of the container 100 is shown. FIG. 7B also depicts two retentions tabs 60*a*, 60*b* located between the continuous outer ring 118 and the A-collar 114.

The top wall portion 20 and the annular skirt portion 26 are made of polymeric material. The top wall portion 20 and the annular skirt portion 26 are typically made of an olefin (e.g., polyethylene (PE), polypropylene (PP)), polyethylene terephthalate (PET) or blends thereof. One example of a polyethylene that may be used is high density polyethylene (HDPE). It is contemplated that the top wall portion and the annular skirt portion may be made of other polymeric materials. The tamper-evident band 34 is typically made of the same materials as the top wall portion 20 and the annular skirt portion 26.

The closures are typically formed by processes such as injection or compression molding, extrusion or the combination thereof.

The container 100 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 100 is typically have an encapsulated oxygen-barrier layer or oxygen barrier material incorporated therein.

In one method of manufacturing the package, a closure and a container are initially provided. A non-limiting example of a closure is the polymeric closure 10 and the container 100 discussed above. The polymeric closure 10 is twisted onto the container 100. The processing of placing and positioning the polymeric closure 10 onto the container 100 is performed in the absence of folding the tamper-evident band 34 of the polymeric closure 10. The tamper-evident band 34 of the closure 10 is not needed to be folded or unfolded.

During one method of manufacturing, the polymeric closure 10 is placed or threaded onto the container 100. During this placement or threading, the plurality of catch teeth 48 slides over the plurality of catch lugs 120. It is contemplated that in another method, the catch teeth could slide around the plurality of catch lugs. In this method, the catch teeth would be located further away from the polymeric top wall portion 20 of the closure 10. During the sliding of the plurality of catch teeth 48 over or around the plurality of catch lugs 120, the catch teeth 48 of the closure 10 may be slightly compressed and elongated, allowing them to more easily pass by the catch lugs without undue interference.

If a user attempts to open the polymeric closure 10 with respect to the container 100 by unthreading, at least one of the plurality of catch teeth 48 will catch a respective one of the plurality of catch lugs 120. It is desirable for more than one of the plurality of catch teeth 48 to catch a respective one of the plurality of catch lugs 120. In one method, each of the plurality of catch teeth 48 mechanically catches and locks with a respective one of the plurality of catch lugs 120.

Figure 8:
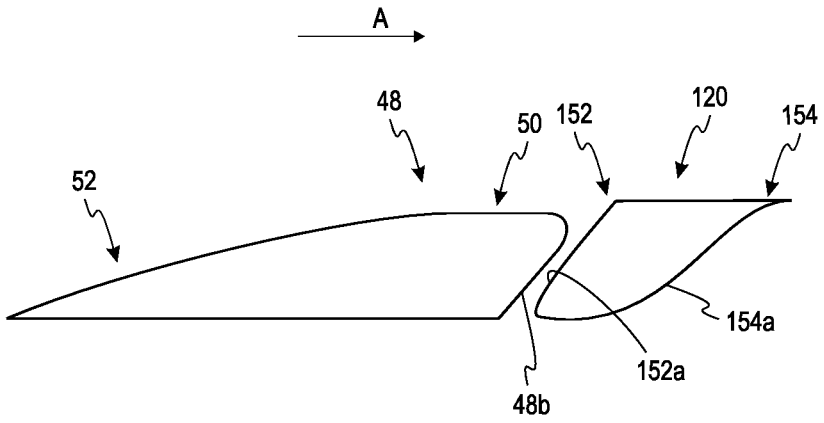
FIG. 8 is a cross-sectional view of one of the catch teeth in the process of engaging one of the catch lugs.

The interaction of one of the plurality of catch teeth 48 just before engaging with one of the plurality of catch lugs 120 is shown in FIG. 8. When a user attempts to unthread the polymeric closure 10 with respect to the container 100 (in the direction of Arrow A in FIG. 8), the catch teeth 48 will move a distance between engaging with the catch lugs. Specifically, surface 48*b* of the catch teeth 48 will engage the surface 152*a* of the catch lugs 120. The distance will depend on the final position of the catch teeth located between adjacent catch lugs. In this embodiment with 8 catch teeth and 8 catch lugs, the distance will not be greater 45 degrees of rotation (360 degrees/8 catch lugs).

Additionally, when the polymeric closure 10 is placed onto the container 100, the plurality of retention tabs 60 engage the continuous upper ring 118 that forms the retention channel 130. As the polymeric closure 10 continues to be placed onto the container 100, the plurality of retention tabs 60 flexes and continues the process of clearing the continuous upper ring 118. Once the plurality of retention tabs 60 clears the continuous upper ring 118, the plurality of retention tabs 60 will then be fully engaged in the retention channel 130. When the plurality of retention tabs 60 are in the retention channel 130, it limits the ability of a user to remove the second closure portion 14 from the container 100 due to the interference and mechanical retention of the plurality of retention tabs 60 relative to the retention channel 130.

When the plurality of catch teeth 48 of the closure 10 slides over the plurality of catch lugs 120, the liner 30, if used, is compressed and elongated in a deformative manner. Once the plurality of catch teeth 48 is past the plurality of catch lugs 120, the liner 30 returns to its original state allowing the plurality of catch teeth 48 to be positioned properly so as to engage the plurality of catch lugs 120 on removal of the polymeric closure 10 from the container 100.

The method of manufacturing advantageously eliminates the need for folding machinery as a downstream operation, which reduces initial tooling cost. The method of manufacturing in one method can utilize in-mold scoring that can eliminate the need for scoring machinery as a downstream operation, which reduces initial tooling cost.

In one method to open the container 100 and gain access to the product therein, the first closure portion 12 is initially twisted with respect to the second closure portion 14. A user than twists the closure 10 generally along the frangible connection 44, which begins breaking the frangible connection 44. The user will continue twisting the closure until there are no more thread engagements between the closure and the container, and the frangible connection has been fully broken.

After the twisting has been completed, a user continues unscrewing the first closure portion 12 from the container 100. While this is occurring, the second closure portion 14 remains fairly close in its original positioning as discussed above because at least one of the plurality of catch teeth 48 engages and locks with a respective one of the plurality of catch lugs 120. The first closure portion 12 is continued to be unscrewed until removed from the container 100.

The polymeric closures are desirable in both low-temperature and high-temperature applications. The polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures.

The polymeric closures may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 244° F. It is contemplated that the polymeric closures can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A package comprising:

a container having a neck portion defining an opening, the neck portion having an exterior surface and an interior surface, the container having an external thread formation and a plurality of catch lugs being located on the exterior surface of the neck portion; and a closure being configured for fitment to the neck portion of the container for closing the opening, the closure comprising a first closure portion and a second closure portion, the first closure portion including a polymeric top wall portion and a polymeric annular skirt portion, the polymeric annular skirt portion depending from the polymeric top wall portion, the polymeric annular skirt portion including an internal thread formation for mating engagement with the external thread formation of the container, the second closure portion including a polymeric tamper-evident band depending from and being partially detachably connected to the polymeric annular skirt portion by a frangible connection, the frangible connection extending around the circumference of the closure, the second closure portion having an exterior surface and an interior surface, the interior surface of the second closure portion including a plurality of catch teeth, at least one of the plurality of catch lugs of the container configured to mechanically catch and lock with a respective one of the plurality of catch teeth of the second closure portion so as to prevent or inhibit the second closure portion from being removed during the opening of the container;

wherein each of the plurality of catch teeth has a first end and a second end, each of the first ends of the plurality of catch teeth having a height and a width greater than a height and a width of the second end, the height and the width of the plurality of catch teeth being tapered from the first end to the second end, the plurality of catch teeth having a length extending along an interior surface of the polymeric tamper-evident band, the length of the plurality of catch teeth being greater than the width of the first end and the width of the second end, the plurality of catch teeth being greater than the height of the first end and the height of the second end.

2. The package of claim 1, wherein the container further includes a retention channel, the retention channel being located on the exterior surface of the neck portion, the retention channel being located between the external thread formation and the plurality of catch lugs, wherein the closure further includes a plurality of retention tabs, the plurality of retention tabs being located on the interior surface of the second closure portion, the plurality of retention tabs being located between the frangible connection and the plurality of catch teeth, wherein the plurality of retention tabs of the closure is configured to engage with the retention channel of the container.

3. The package of claim 2, wherein the neck portion of the container further includes a continuous outer ring and an A-collar, the continuous outer ring and the A-collar assisting in forming the retention channel.

4. The package of claim 2, wherein the retention channel extends around the entire circumference of the neck portion of the container.

5. The package of claim 2, wherein the plurality of retention tabs is at an angle of from about 30 to about 60 degrees relative to the tamper-evident band and extending upwardly towards the polymeric top wall portion.

6. The package of claim 1, wherein the closure further includes a liner, the liner being located adjacent to an interior surface of the polymeric top wall portion.

7. The package of claim 1, wherein the external thread formation of the container is one continuous helical thread, and wherein the internal thread formation of the closure is one continuous helical thread.

8. The package of claim 1, wherein the length of the plurality of catch teeth is from about 0.2 to about 0.75 inch, the height of the first end is from about 0.05 inch to about 0.10 inch, and the width of the first end is from about 0.02 to about 0.063 inch.

9. The package of claim 1, wherein each of the first ends of the plurality of catch teeth has a surface being angled inwardly, at least one of the surfaces of the first end of the plurality of catch teeth being configured to mechanically catch and lock with a respective one of the plurality of catch teeth.

10. The package of claim 1, wherein the frangible connection is formed by molded-in-bridges.

11. A package comprising:

a container having a neck portion defining an opening, the neck portion having an exterior surface and an interior surface, the container having an external thread formation and a plurality of catch lugs being located on the exterior surface of the neck portion; and a closure being configured for fitment to the neck portion of the container for closing the opening, the closure comprising a first closure portion and a second closure portion, the first closure portion including a polymeric top wall portion and a polymeric annular skirt portion, the polymeric annular skirt portion depending from the polymeric top wall portion, the polymeric annular skirt portion including an internal thread formation for mating engagement with the external thread formation of the container, the second closure portion including a polymeric tamper-evident band depending from and being partially detachably connected to the polymeric annular skirt portion by a frangible connection, the frangible connection extending around the circumference of the closure, the second closure portion having an exterior surface and an interior surface, the interior surface of the second closure portion including a plurality of catch teeth, at least one of the plurality of catch lugs of the container configured to mechanically catch and lock with a respective one of the plurality of catch teeth of the second closure portion so as to prevent or inhibit the second closure portion from being removed during the opening of the container, wherein each of the plurality of catch lugs has a first end and a second end, each of the first ends of the plurality of catch lugs having a surface being angled inwardly, each of the first ends of the plurality of catch lugs having a height and a width greater than a height and a width of the second ends, the height and the width of the plurality of catch lugs being tapered from the first end to the second end.

12. The package of claim 1, wherein the number of catch teeth is from about 4 to about 20, and wherein the number of catch lugs is from about 4 to about 20.

13. The package of claim 12, wherein the number of catch teeth is from about 6 to about 18, and wherein the number of catch lugs is from about 6 to about 18.

14. The package of claim 1, wherein each of the plurality of catch lugs of the container is configured to mechanically catch and lock with a respective one of the plurality of catch teeth of the second closure portion so as to prevent or inhibit the second closure portion from being removed during the opening of the container.

15. A package comprising:

a container having a neck portion defining an opening, the neck portion having an exterior surface and an interior surface, the container having an external thread formation, a plurality of catch lugs, and a retention channel being located on the exterior surface of the neck portion, the retention channel being located between the external thread formation and the plurality of catch lugs, the neck portion further including a continuous outer ring and an A-collar, the continuous outer ring and the A-collar assisting in forming the retention channel, the retention channel further having an outer surface located between the A-collar and the continuous outer ring that has a smaller circumference than both the A-collar and the continuous outer ring; and a closure being configured for fitment to the neck portion of the container for closing the opening, the closure comprising a first closure portion and a second closure portion, the first closure portion including a polymeric top wall portion and a polymeric annular skirt portion, the polymeric annular skirt portion depending from the polymeric top wall portion, the polymeric annular skirt portion including an internal thread formation for mating engagement with the external thread formation of the container, the second closure portion including a polymeric tamper-evident band depending from and being partially detachably connected to the polymeric annular skirt portion by a frangible connection, the frangible connection extending around the circumference of the closure, the second closure portion having an exterior surface and an interior surface, the interior surface of the second closure portion including a plurality of catch teeth and a plurality of retention tabs, the plurality of retention tabs being located between the frangible connection and the plurality of catch teeth, wherein at least one of the plurality of catch lugs of the container is configured to mechanically catch and lock with a respective one of the plurality of catch teeth of the second closure portion so as to prevent or inhibit the second closure portion from being removed during the opening of the container, wherein the plurality of retention tabs of the closure is configured to engage with the retention channel of the container, wherein the number of catch teeth is from about 4 to about 20, and wherein the number of catch lugs is from about 4 to about 20.

16. The package of claim 15, wherein the retention channel extends around the entire circumference of the neck portion of the container.

17. The package of claim 15, wherein the plurality of retention tabs is at an angle of from about 30 to about 60 degrees relative to the tamper-evident band and extending upwardly towards the polymeric top wall portion.

18. The package of claim 15, wherein the length of the plurality of catch teeth is from about 0.2 to about 0.75 inch, the height of the first end is from about 0.05 inch to about 0.10 inch, and the width of the first end is from about 0.02 to about 0.063 inch.

19. The package of claim 15, wherein each of the first ends of the plurality of catch teeth has a surface being angled inwardly, at least one of the surfaces of the first end of the plurality of catch teeth being configured to mechanically catch and lock with a respective one of the plurality of catch teeth.

20. The package of claim 15, wherein each of the plurality of catch lugs of the container is configured to mechanically catch and lock with a respective one of the plurality of catch teeth of the second closure portion so as to prevent or inhibit the second closure portion from being removed during the opening of the container.

21. The package of claim 15, wherein the frangible connection is formed by molded-in-bridges.

22. A package comprising:

a container having a neck portion defining an opening, the neck portion having an exterior surface and an interior surface, the container having an external thread formation, a plurality of catch lugs, and a retention channel being located on the exterior surface of the neck portion, the retention channel being located between the external thread formation and the plurality of catch lugs; and a closure being configured for fitment to the neck portion of the container for closing the opening, the closure comprising a first closure portion and a second closure portion, the first closure portion including a polymeric top wall portion and a polymeric annular skirt portion, the polymeric annular skirt portion depending from the polymeric top wall portion, the polymeric annular skirt portion including an internal thread formation for mating engagement with the external thread formation of the container, the second closure portion including a polymeric tamper-evident band depending from and being partially detachably connected to the polymeric annular skirt portion by a frangible connection, the frangible connection extending around the circumference of the closure, the second closure portion having an exterior surface and an interior surface, the interior surface of the second closure portion including a plurality of catch teeth and a plurality of retention tabs, the plurality of retention tabs being located between the frangible connection and the plurality of catch teeth, wherein at least one of the plurality of catch lugs of the container is configured to mechanically catch and lock with a respective one of the plurality of catch teeth of the second closure portion so as to prevent or inhibit the second closure portion from being removed during the opening of the container, wherein the plurality of retention tabs of the closure is configured to engage with the retention channel of the container, wherein the number of catch teeth is from about 4 to about 20, and wherein the number of catch lugs is from about 4 to about 20, wherein each of the plurality of catch lugs has a first end and a second end, each of the first ends of the plurality of catch lugs having a surface being angled inwardly, each of the first ends of the plurality of catch lugs having a height and a width greater than a height and a width of the second ends, the height and the width of the plurality of catch lugs being tapered from the first end to the second end.

* * * * *